US005497899A

United States Patent [19]

Wuerfel

[11] Patent Number: 5,497,899

[45] Date of Patent: Mar. 12, 1996

[54] COMPOSITE PACKAGE

[75] Inventor: Scott P. Wuerfel, Memphis, Tenn.

[73] Assignee: Ring Can Corporation, Memphis, Tenn.

[21] Appl. No.: 382,633

[22] Filed: Feb. 2, 1995

[51] Int. Cl.[6] ..... B65D 5/462

[52] U.S. Cl. ..... 220/465; 220/410; 229/117.13

[58] Field of Search ..... 220/410, 465, 220/468; 229/117.13, 117.14; 222/183, 465.1, 466

[56] References Cited

U.S. PATENT DOCUMENTS

| | | | |
|---|---|---|---|
| 2,019,307 | 10/1935 | Hill et al. | 229/117.13 |
| 2,760,677 | 8/1956 | Arneson | 229/117.13 |
| 2,954,901 | 10/1960 | Winstead | 220/410 |
| 3,054,549 | 9/1962 | Humphrey . | |
| 3,119,544 | 1/1964 | Cope et al. | 222/465.1 |
| 3,160,326 | 12/1964 | Sturdevant et al. | 222/466 |
| 3,349,986 | 10/1967 | Chapman et al. . | |
| 3,499,582 | 3/1970 | Berney . | |
| 4,133,428 | 1/1979 | Glöyer | 229/117.13 |
| 4,174,051 | 11/1979 | Edwards et al. | 220/465 |
| 4,314,639 | 2/1982 | Gloyer . | |
| 4,927,042 | 5/1990 | Ring | 229/117.13 |

FOREIGN PATENT DOCUMENTS

| | | | |
|---|---|---|---|
| 833952 | 2/1970 | Canada . | |
| 877792 | 8/1971 | Canada | 229/117.13 |
| 2942941 | 5/1981 | Germany | 229/117.13 |

*Primary Examiner*—Gary E. Elkins

*Attorney, Agent, or Firm*—Nies, Kurz, Bergert & Tamburro

[57] ABSTRACT

A composite package including a plastic bottle mounted in an outer paperboard box. The bottle has a pouring spout adjacent its front wall and an elongated handle extending from the pouring spout to its rear wall. The box includes a top end flap assembly having minor side flaps and front and rear flaps which fold over onto the side flaps. The minor flaps include front cutout sections which provide clearance around the spout and rearward portions having full bearing support areas extending from the cutout section to the rear wall, the bearing support areas resting directly on top of the handle of the bottle to provide load bearing support for the flaps during the gluing process. The side minor flaps also include elongated slots extending generally parallel to and alongside the handle and the rear flap has laterally spaced elongated slots which overlie the slots in the side flaps to provide cooperating hand openings on both sides of the bottle handle so that the handle may be grasped and liquid may be poured from the bottle through the spout.

2 Claims, 2 Drawing Sheets

COMPOSITE PACKAGE

BACKGROUND OF THE INVENTION

This invention relates generally to a composite package including a plastic bottle contained in an outer paperboard box and, more particularly, to a novel design of the minor side flaps at the upper end of the paperboard box.

The assignee of this application has manufactured and sold a prior art composite package including a plastic rectangular bottle contained in an outer paperboard box. The bottle may contain 2 ½ to 5 gallons of liquid, such as cooking oil. At its upper end, the bottle has a pouring spout adjacent its front wall and a hollow elongated handle extending from the spout to its rear wall. The upper end of the carton has a foldable flap assembly which includes two minor side flaps, each having a cutout adjacent the front wall of the carton to accommodate the spout of the bottle and a second cutout adjacent the rear wall of the carton to provide hand clearance for access to the handle. A small tab is located between the cutouts. The carton also includes major front and rear flaps with the front flap having an opening which overlies the spout of the bottle and the rear flap having a pair of parallel slots separated by a solid center strip. To close the flap assembly, the minor flaps are folded first so that the small tabs rest on top of the handle of the bottle. Glue is applied on top of the minor flaps and the major flaps are then folded inwardly and pressed down on top of the minor flaps.

During the gluing operation, the only support for the minor flaps is the small tab which rests on the top of the bottle handle. If the tab is bent or torn during assembly, it has little or no contact with the handle, and the tab provides no support. Thus the glue joint is either of poor quality or nonexistent The small width of the tab also complicates the fabrication of the carton at the corrugator. Because of the small width, the carton is difficult to square in the corrugation machine, thus causing a high scrap rate. As a result, many corrugators run the carton in a two pass operation, which, of course, increases cost of production.

SUMMARY OF THE INVENTION

Accordingly, the primary object of this invention is to provide a novel composite package of the type described above, wherein the minor side flaps of the paperboard box have an enlarged bearing area by which they rest on the handle of the bottle, thus creating a stronger minor flap and a better glue bond.

Still another object of this invention resides in the provision of the above novel composite package wherein each of the minor flaps includes a full bearing portion at its inner edge extending from its rear edge to the front cutout portion with the opposed bearing areas of the minor flaps overlying and resting on the top of the bottle handle during the gluing process.

A further object of the invention is to provide the above novel composite package wherein each minor flap includes an elongated handholding cutout running parallel to the handle of the bottle. When the upper flap assembly is folded in place, handholding slots on the rear flap overlie the handholding slots in the minor flaps parallel to and on opposite sides of the handle so that the handle of the bottle may be readily grasped to pour liquid from the bottle.

A further object of the invention resides in the provision of the above described composite package wherein the novel minor flap design facilitates the manufacture of the corrugated box by enabling the corrugators to run the box through the corrugating machine in one pass, thus resulting in a substantial cost savings.

Other objects and advantages will become more apparent from reading the following detailed description of the invention wherein reference is made to the accompanying drawings in which like numerals indicate like elements.

DETAILED DESCRIPTION OF THE INVENTION

Figure 1:
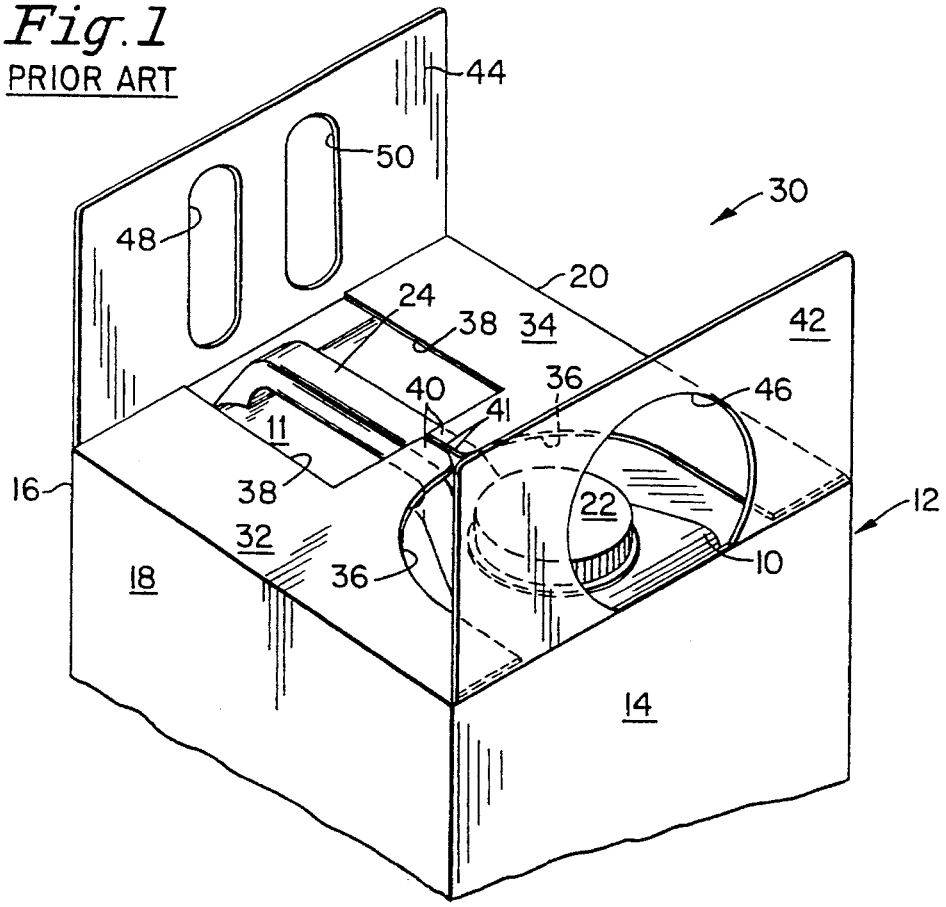
Fig. 1 PRIOR ART
FIG. 1 is a fragmentary elevational perspective of the prior art composite package described hereinabove which has been sold by the assignee of this invention.

The prior art composite package described hereinabove is generally illustrated in FIG. 1 and includes a square plastic bottle 10 of the type generally illustrated in U.S. Pat. No. 5,114,028, fitted within an outer corrugated paperboard box 12. Box 12 includes a front wall 14, a rear wall 16 and side walls 18 and 20.

Bottle 10 includes vertical side, front, and rear walls covered by a top wall 11 on which pouring spout 22 is located adjacent front wall 14 and an integral hollow handle 24 extends from spout 22 to the rear wall of the bottle adjacent the rear wall 16.

Box 12 includes at its top end a flap assembly 30 comprising minor side flaps 32 and 34 which fold over perpendicularly from side walls 18 and 20, respectively. Each of those minor flaps has a front cutout portion 36 which together provide clearance around spout 22. Flaps 32 and 34 also include rear cutout portions 38 extending alongside handle 24 to provide hand openings alongside the handle. Each of the flaps 32 and 34 includes a central tab 40 which separates cutouts 36 and 38, the tabs 40 extending inwardly with their inner edges 41 opposing each other and overlying handle 24.

Flap assembly 30 also includes major front and rear flaps 42 and 44 which fold inwardly from front wall 14 and rear wall 16, respectively, to overlie minor flaps 32 and 34. Front flap 42 has a cutout opening 46 which surrounds spout 22 and provides access to the cap normally covering the spout. Rear flap 44 includes a pair of laterally spaced elongated slots 48 and 50 which may or may not be provided with perforated knock-out sections. When flap 44 is folded downwardly onto flaps 32 and 34, slots 48 and 50 overlie the cutout sections 38 of flaps 32 and 34 and together therewith provide suitable hand openings through which handle 24 may be grasped.

The width of each of the minor flaps 32 and 34 from its fold line at side walls 18 and 20 to the inner edge 41 of tabs 40 is approximately half the width of front walls 14 and 16, so that the inner edges 41 almost abut against each other.

Similarly, the width of flaps 42 and 44 from their fold lines with walls 14 and 16 is approximately half the length of side walls 18 and 20, so that the inner edges at flaps 42 and 44 almost abut against each other.

As mentioned hereinabove, because the width of tabs 40 extending in the direction of handle 24 is so small, the tabs provide little support for minor flaps 32 and 34 when flaps 42 and 44 are folded over onto flaps 32 and 34 during the gluing process. If tab 40 is bent or torn during assembly, it provides little or no support on top of handle 24, and the glue joint between flaps 32, 34, 42, and 44 is either of poor quality or nonexistent.

Figure 2:
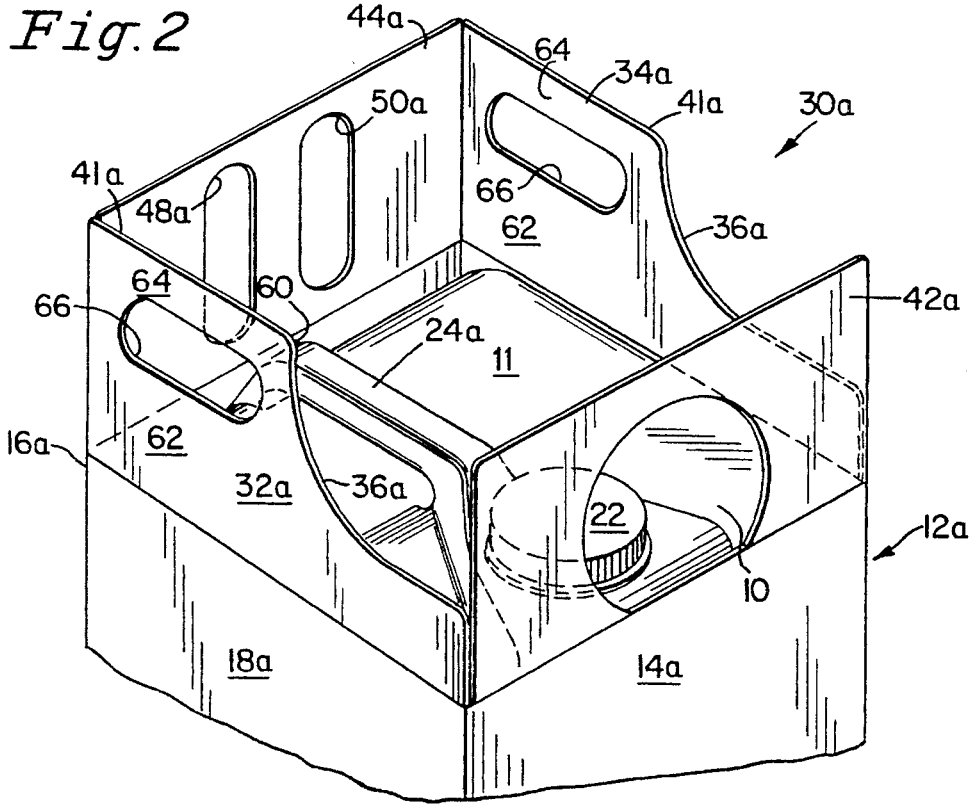
FIG. 2 is a fragmentary elevational perspective view of the composite package of the invention, illustrating the top end flap assembly in its open, unfolded position.
Figure 3:
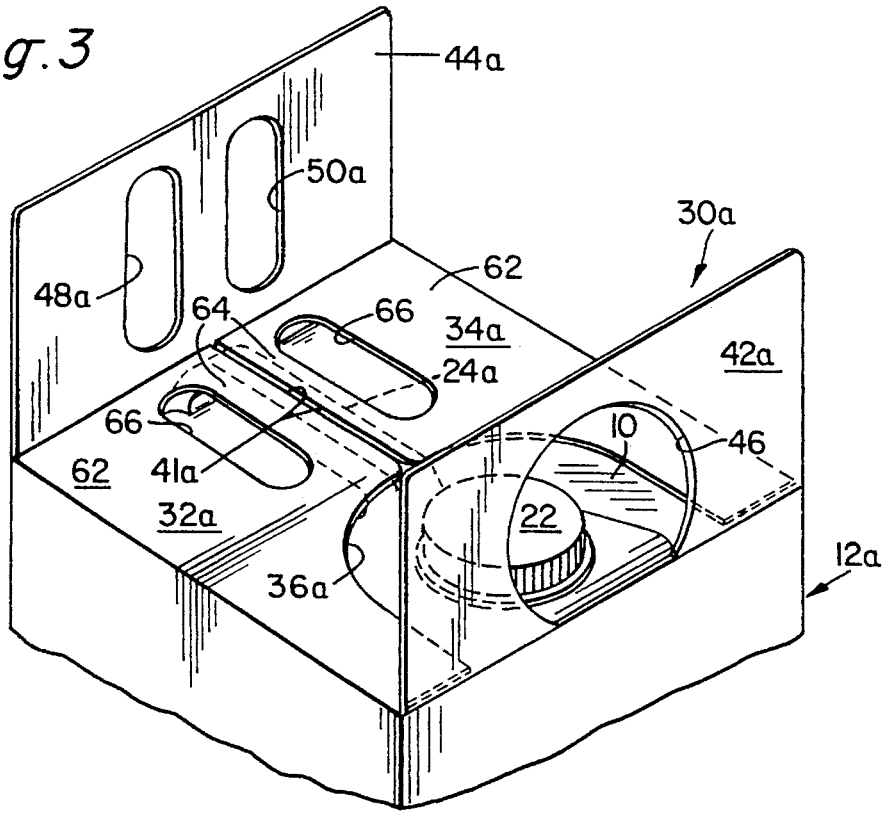
FIG. 3 is a fragmentary perspective view of the composite package showing the minor side flaps of the top end flap assembly in their folded positions.
Figure 4:
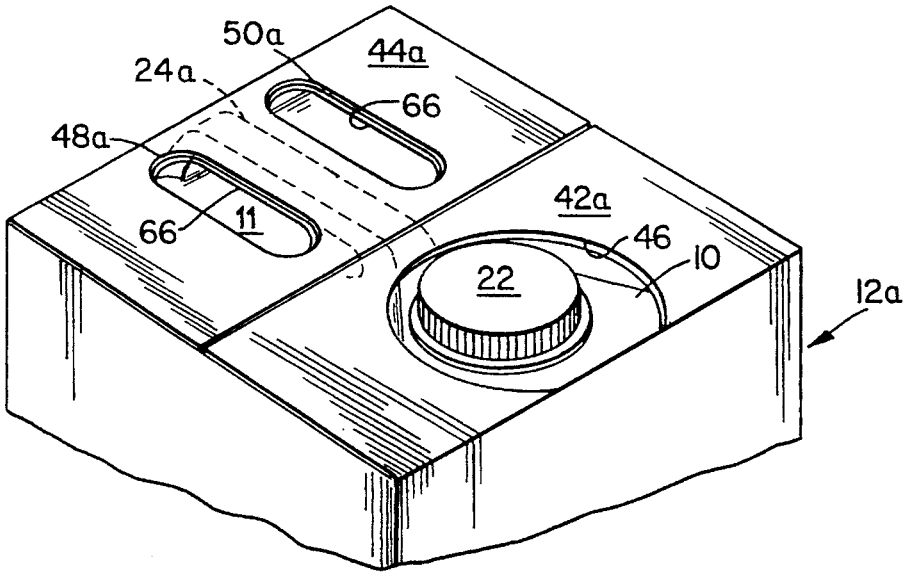
FIG. 4 is a view similar to FIG. 3, showing the front and rear flaps in their folded glued positions.

To overcome this problem associated with the prior art composite package of FIG. 1, applicant has developed the novel flap assembly illustrated in FIGS. 2–4. The invention lies in the modification of the construction of the minor flaps 32*a* and 34*a*. In all other respects, the box 12*a* may be identical to the box 12 of FIG. 1. The front portions of flaps 32*a* and 34*a* include the front cutout sections 36*a* which terminate at the inner edge 41*a* at a point 60 which is somewhat less than half the distance between walls 14*a* and 16*a*. The rearward portions 62 of flaps 32*a* and 34*a* extend the full length from point 60 to rear wall 16*a* and have a full width from the fold line with wall 18*a* to the inner edge 41*a* to provide an elongated full bearing support area 64 resting directly on top of handle 24*a* during the gluing process. (See FIG. 3.) Rear portions 62 are also provided with elongated slots 66 which run parallel to side walls 18*a* and 20*a* and provide hand receiving openings alongside handle 24*a*. As flaps 42*a* and 44*a* are folded inwardly onto flaps 32*a* and 34, slots 48*a* and 50*a* will overlie slots 66 to provide hand openings on both sides of handle 24*a* through which the handle may be grasped so that liquid may be poured from the spout.

As flap assembly 38*a* is folded and glued together the elongated bearing portions 64 of minor flaps 32*a* and 34*a* provide a substantially greater area of support resting on handle 24*a* to strengthen the minor flaps. This produces a better and stronger glue bond between flaps 32*a*, 34*a* and flaps 42*a* and 44*a*. During assembly of the flaps, the elongated bearing sections 64 retain their integrity and avoid the bending or tearing problems which were prevalent with the small tabs 40 of the prior art construction shown in FIG. 1.

The substantial length of the elongated sections 64 and inner edges 41*a* of flaps 32*a* and 34*a* also simplify the fabrication of the corrugated box 12*a* at the corrugator. The elongated square edges 41*a* provide a much larger area against which the box may be squared in the machine, and the corrugator may easily run the box through the machine in one pass, thus producing substantial savings in production costs.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Composite package comprising:

an outer, rectangular paperboard box and a thin walled rectangular plastic bottle within said box;

said bottle having vertical front, rear, first and second side walls, and a top wall extending across said vertical walls, a pouring spout formed on said top wall adjacent said front wall, a handle formed on said top wall and extending between said pouring spout and said rear wall;

said paperboard box including front, rear, and first and second sidewalls adjacent the front rear and first and second sidewalls respectively of said bottle, said box having a top flap assembly including first and second side flaps connected to the side walls of said box and folded substantially perpendicular to said side walls, front and rear flaps connected to said front and rear walls of said box and folded over said side flaps, said first and second side flaps having front portions including a cut out section to provide clearance around said spout and rear portions extending rearwardly from said cutout sections to said rear wall of said box, said rear portions having inner edges which extend rearwardly substantially the full length from said cutout sections to said rear wall of said box, said inner edges overlying and resting on said handle to support said side flaps as said front and rear flaps are glued to said side flaps, said rear portions having first hand openings extending generally parallel to said inner edges and arranged alongside said handle, said rear flap having second hand openings which overlie said first hand openings so that said handle may be gripped through said first and second hand openings, and said front flap having an opening overlying said spout.

2. The composite package defined in claim 1, wherein said first hand openings are slots extending generally parallel to said handle.

* * * * *